US006167576B1

(12) United States Patent
Sollami

(10) Patent No.: US 6,167,576 B1
(45) Date of Patent: Jan. 2, 2001

(54) VENTILATED TOILET SEAT

(76) Inventor: Jimmie L. Sollami, 1017 Weaver Rd., Herrin, IL (US) 62948

( * ) Notice: Under 35 U.S.C. 154(b), the term of this patent shall be extended for 0 days.

(21) Appl. No.: 09/456,706

(22) Filed: Dec. 9, 1999

(51) Int. Cl.[7] ..... E03D 9/04
(52) U.S. Cl. ..... 4/217
(58) Field of Search ..... 4/213, 217

(56) References Cited

U.S. PATENT DOCUMENTS

| | | | | |
|---|---|---|---|---|
| 629,462 | * | 7/1899 | Old | 4/217 |
| 988,273 | | 3/1911 | Levenhagen et al. . | |
| 1,972,076 | * | 9/1934 | Cross | 4/217 |
| 2,072,780 | | 3/1937 | Turner . | |
| 2,099,875 | | 11/1937 | Weaver . | |
| 2,240,094 | * | 4/1941 | Foreman | 4/217 |
| 2,286,555 | | 6/1942 | Long . | |
| 3,192,539 | | 7/1965 | Martz . | |
| 3,416,167 | | 12/1968 | Klemme . | |
| 3,491,382 | * | 1/1970 | Poister | 4/217 |
| 3,733,619 | | 5/1973 | Smith . | |
| 3,763,505 | | 10/1973 | Zimmerman . | |
| 3,781,923 | | 1/1974 | Maisch et al. . | |
| 3,902,203 | | 9/1975 | Poister . | |
| 3,913,150 | | 10/1975 | Poister . | |
| 3,916,459 | | 11/1975 | Ivancecic . | |
| 3,939,201 | | 2/1976 | McGrew . | |
| 3,999,225 | | 12/1976 | Ables . | |
| 4,007,498 | | 2/1977 | Pearson . | |
| 4,011,608 | | 3/1977 | Pearson . | |
| 4,031,574 | | 6/1977 | Werner . | |
| 4,044,408 | | 8/1977 | Pearson . | |
| 4,085,470 | | 4/1978 | Roberts . | |
| 4,094,023 | * | 6/1978 | Smith | 4/217 X |
| 4,117,559 | | 10/1978 | Boyle . | |
| 4,125,906 | * | 11/1978 | Weiland | 4/217 |
| 4,153,956 | | 5/1979 | Fischer, Sr. et al. . | |
| 4,175,293 | | 11/1979 | Stephens . | |
| 4,232,406 | | 11/1980 | Beeghly et al. . | |
| 4,251,888 | | 2/1981 | Turner . | |
| 4,365,361 | | 12/1982 | Sanstrom . | |
| 4,556,999 | | 12/1985 | Lindley . | |
| 4,617,687 | | 10/1986 | Wadsworth . | |
| 4,701,966 | | 10/1987 | Schafer . | |
| 4,726,078 | | 2/1988 | Carballo et al. . | |
| 4,882,790 | | 11/1989 | Ricard . | |
| 4,893,359 | | 1/1990 | Vu et al. . | |
| 4,984,310 | | 1/1991 | Cassale . | |
| 5,345,617 | | 9/1994 | Jahner et al. . | |
| 5,539,937 | | 7/1996 | Barefoot . | |

FOREIGN PATENT DOCUMENTS

| | | |
|---|---|---|
| 17485224 | 4/1989 | (FR) . |
| 2143872A | 2/1985 | (GB) . |

* cited by examiner

*Primary Examiner*—Charles E. Phillips
(74) *Attorney, Agent, or Firm*—Pitts & Brittian, P.C.

(57) ABSTRACT

A ventilated toilet seat assembly for evacuating noxious odors from within a toilet bowl. The ventilated toilet seat defines an external channel on the lower surface thereof between a pair of concentric risers, including an innermost riser and an outermost riser, each being configured to form a seal along the surface of the toilet bowl when the ventilated toilet seat is lowered into engagement therewith. The innermost riser defines a plurality of openings to provide for fluid communication from within the toilet bowl to the channel. An outlet is defined between the external channel and a hinge assembly, which includes a hinge post for mounting the ventilated toilet seat to a conventional toilet. The hinge post defines an internal conduit for evacuating the air within the toilet to an external location. The ventilated toilet seat may include a toilet seat upper and a riser plate secured thereto and which defines the concentric risers on the bottom surface thereof

6 Claims, 9 Drawing Sheets

VENTILATED TOILET SEAT

This application in part discloses and claims subject matter disclosed in my earlier filed pending application, Ser. No. 09/121,213, filed on Jul. 23, 1998, now abandoned, which in part disclosed and claimed subject matter disclosed in my earlier filed application, Ser. No. 08/898,048, filed on Jul. 22, 1997, now abandoned, which in part disclosed and claimed subject matter disclosed in my earlier filed application, Ser. No. 08/774,870, filed on Dec. 19, 1996, now abandoned.

BACKGROUND OF THE INVENTION

1. Technical Field

This invention relates to the field of toilet ventilation. More specifically, the present invention relates to a toilet seat construction for ventilating fumes from within a toilet.

2. Background Art

The need for ventilating a toilet bowl has long been recognized. Accordingly, many devices have been developed to provide such a function. These devices include toilet bowls which have integrally formed vents, tanks with integrally formed vents, vented seats, suction devices for pumping air out, filters for cleaning the air and replacing it into the atmosphere or the toilet bowl, and many others. Typical of the art are those devices disclosed in the following U.S. patents and foreign patent documents:

| Pat. No. | Inventor(s)/(Country) | Issue Date |
|---|---|---|
| 2,072,780 | F. L. Turner | Mar. 2, 1937. |
| 2,099,875 | C. J. Weaver | Nov. 23, 1937. |
| 2,286,555 | W. Long | Jun. 16, 1942. |
| 3,192,539 | W. L. Martz | Jul. 6, 1965. |
| 3,416,167 | W. R. Klemme | Dec. 17, 1968. |
| 3,733,619 | F. D. Smith | May 22, 1973. |
| 3,763,505 | J. P. Zimmerman | Oct. 9, 1973. |
| 3,781,923 | H. Maisch, et al. | Jan. 1, 1974. |
| 3,902,203 | C. E. Poister, et al | Sep. 2, 1975. |
| 3,913,150 | C. E. Poister, et al. | Oct. 21, 1975. |
| 3,916,459 | M. Ivancevic | Nov. 4, 1975. |
| 3,938,201 | D. McGrew | Feb. 17, 1976. |
| 3,999,225 | E. O. Ables | Dec. 28, 1976. |
| 4,007,498 | R. H. Pearson | Feb. 15, 1977. |
| 4,011,608 | R. H. Pearson | Mar. 15, 1977. |
| 4,031,574 | F. D. Werner | Jun. 28, 1977. |
| 4,044,408 | R. H. Pearson | Aug. 30, 1977. |
| 4,085,470 | G. Roberts | Apr. 25, 1978. |
| 4,117,559 | D. D. Boyle | Oct. 3, 1978. |
| 4,153,956 | R. C. Fischer, Sr., et al. | May 15, 1979. |
| 4,175,293 | W. J. Stephens, et al. | Nov. 27, 1979. |
| 4,232,406 | L. R. Beeghly, et al. | Nov. 11, 1980. |
| 4,365,361 | G. H. Sanstrom | Dec. 28, 1982. |
| 4,556,999 | J. E. Lindley | Dec. 10, 1985. |
| 4,617,687 | J. A. Wadsworth | Oct. 21, 1986. |
| 4,701,966 | C. L. Schafer | Oct. 27, 1987. |
| 4,726,078 | R. A. Carballo, et al. | Feb. 23, 1988. |
| 4,882,790 | V. F. Ricard | Nov. 28, 1989. |
| 4,893,359 | P. N. Vu, et al. | Jan. 16, 1990. |
| 4,984,310 | E. Casale | Jan. 15, 1991. |
| 5,345,617 | J. F. Jahner, et al. | Sep. 13, 1994. |
| 5,539,937 | R. E. Barefoot | Jul. 30, 1996. |
| GB 2 143 872 A | (United Kingdom) | Feb. 20, 1985. |
| 89-174852/24 | (France) | Apr. 28, 1989. |

Of these devices, a generic ventilation device is taught by Weaver ('875) wherein an exhaust stack is illustrated as connecting between the inside of the toilet bowl and the outside of the building. As described, the fumes within the bowl are exhausted when the toilet is flushed. However, such an arrangement is often not adequate to deal with fumes prior to flushing the toilet. Specifically, it is well known that unpleasant odors may emanate the room prior to flushing the toilet. And, further, without adequate room ventilation, such odors may linger for a substantial period of time. McGrew ('201) teaches a similar device having a time delay opening switch operable by the user in order to turn on the fan for a selected period of time.

Turner ('780) teaches a ventilating apparatus having a pressure sensitive switch to activate a heater when weight is applied to the toilet seat. The heater is provided for heating the air in the bowl, thus creating an updraft of the air within the bowl. A vent to the outside is provided for the escape of air as a result of the updraft created. Therefore, such a device is activated only when a person is seated on the toilet. Further, the updraft is only created after the air has had the opportunity to heat, thus creating a lag between the time a person sits of the seat and the time the air is evacuated. Poister, et al. ('203 and '150); Ivancevic ('459); Wadsworth ('687); and Vu, et al. ('359) each teach a ventilation device having a pressure sensitive switch as well.

Martz ('539) teaches a ventilator having an exhaust fan built into the ceiling or attic structure of the building in order to draw air from within the toilet bowl However, such fans are typically employed to draw air from within the entire room, and therefore do not have the ability to draw a high volume of air from within the toilet bowl. The fan used in the '539 device is operated via a switch carried on the wall of the bathroom proximate the door, as described. Therefore, operation of the fan must be accomplished prior to or after using the toilet. Similarly, the Ricard ('790) device is provided with an exhaust line directed toward a room exhaust fan. The switch in the '790 device is illustrated as being in reach of the toilet such that the fan may be actuated at any time.

The device disclosed by Zimmerman ('505) uses the overflow pipe for evacuating odors from the toilet bowl. A ventilator placed over the tank in lieu of the conventional cover is provided with a blower and a filter unit. The blower serves to draw air from within the toilet bowl, through the overflow pipe, through the filter, and into the room. In another embodiment, the evacuated air is delivered to a remote filter and then introduced into the room. A timer switch is provided for selecting a period of time during which the fan is turned on. However, Zimmerman does not teach a means for remotely-controlling the exhaust device. The device disclosed by Maisch, et al. ('923) is similar to that of Zimmerman.

The device disclosed by Ivancevic ('459) is a kit used in cooperation with a conventional toilet bowl whereby ventilation is accomplished through the toilet seat axle and the toilet seat. The toilet seat defines an opening directed to the toilet seat axle, which is designed to serve as a conduit between the opening in the toilet seat to the sewage plumbing system. Those devices disclosed by Roberts ('470); Boyle ('559); and Stephens, et al. ('293), are similar to that of Ivancevic.

Pearson ('408, '498 and '608) teaches the use of the overflow conduit normally used for the passage of waste for use in communication odors from within the toilet bowl to a remote location. A switch is provided for initiating air flow from within the toilet bowl. When the toilet is flushed, the ventilation is automatically terminated. These devices are similar to those disclosed by Fischer, Sr., et al. ('956); and Beeghly, et al. ('406).

Werner ('574) teaches a timed ventilator having a pneumatic delay switch. The unit is contained entirely within the tank of the toilet. However, Werner does not disclose a remotely controllable device for initiating and ceasing activation of the ventilation device.

The device disclosed by Sanstrom ('361) draws air from within the toilet bowl and exhausts the same into the sewer system. To accomplish this, a spacer assembly is positioned between the toilet and the floor. The '361 device is powered through the room A.C. current via a push-button switch, or via a wall switch provided for controlling the activation of the circuit into which the device is plugged.

As described by Lindley, the '999 device has "a plurality of circumferentially arranged radially inwardly directed air inlet passages adjacent the bowl rim for the intake of ambient air surrounding the commode." Another plurality of passages is provided for evacuation of air within the toilet bowl. The inlet of air creates turbulence within the bowl in order for the fumes within the bowl to mix with the fresh air to enable evacuation thereof. A pressure sensitive switch is used to activate the device. Also disclosed, although not shown, is a time delay switch for allowing the operation of the device after the user is no longer seated on the toilet. Similarly, the Ables ('225); Carballo, et al. ('078); Casale ('310); and Jahner, et al. ('617), devices are toilet seats having an air duct defined therein for the removal of fumes.

The Schafer ('966) device is similar to those disclosed by Ivancevic ('459); Roberts ('470); Boyle ('559); and Stephens, et al. ('293), above. Although not shown, however, Schafer discloses that the '966 device may be operated via a remote control hand-held device.

The prior art devices discussed above provide many different ways of evacuating the air from within a toilet bowl. However, none of these devices disclose a toilet seat which provides a conduit on the exterior of the toilet seat for the passage of air withdrawn from the toilet. While the molding process of a toilet seat having an internal conduit is known to be expensive, it is also difficult to clean such a conduit. Especially in commercial or public restroom facilities, while also certainly in residential use, it is essential to thoroughly clean all surfaces of the toilet seat in order to protect the health of anyone who may contact the toilet seat.

Therefore, it is an object of this invention to provide an improved ventilated toilet seat for evacuating noxious odors from within a toilet bowl and preventing the same from emanating into the room.

It is also an object of the present invention to provide a means for selectively controlling the operation of a fan for suctioning the noxious fumes from the toilet bowl.

Another object of the present invention is to provide a means for adapting suction lines between the toilet seat and the fan for simple installation and use.

Still another object of the present invention is to provide a means for ventilating a toilet wherein a toilet seat is provided with a simple conduit to communicate air between the interior of the toilet bowl to an exhaust system.

Still yet another object of the present invention is to provide an exposed conduit in order to facilitate proper cleaning of the toilet seat.

DISCLOSURE OF THE INVENTION

Other objects and advantages will be accomplished by the present invention which provides a ventilated toilet seat for evacuating noxious odors from within a toilet bowl. In the preferred embodiment the toilet seat assembly is designed to be selectively operated using a remote control device, thereby reducing risk of electrical shock, allowing for the operation of the device only when necessary, and for reducing the expense of retrofitting an existing structure. Further, the ventilated toilet seat of the present invention is provided with an exposed conduit for facilitating thorough cleaning of the toilet seat and for reducing the cost of manufacture over conventionally constructed ventilated toilet seats.

The ventilated toilet seat assembly of the present invention is used in conjunction with a fan assembly for drawing the noxious odors from within the toilet bowl. The noxious odors may be evacuated from the toilet to a conventional room exhaust fan mounted in the ceiling or wall. Alternatively, in those embodiments wherein the fan assembly includes an air filter or an air freshener of some sort, the freshened air may be returned directly to the room. To accomplish either, at least one hose is connected to the outlet of the ventilated toilet seat. A distal end of each hose is connected to the fan assembly such that the fan assembly is ultimately in fluid communication with the interior of the toilet bowl. Thus, as the fan is operated, contaminated air within the toilet bowl is drawn from within the toilet bowl, through the ventilated toilet seat, through the hoses, and evacuated to a selected location.

The ventilated toilet seat of the present invention defines a channel on the lower surface thereof, defined between two concentric risers. A plurality of openings are defined in the inner riser to provide for fluid communication from within the toilet bowl to the channel. An outlet is defined between the channel and the hinge assembly. The hinge assembly is provided both for securing the ventilated toilet seat to the toilet bowl, and for evacuating the air from within the toilet bowl to at least one hose. To this extent the hinge includes a post for being received in an opening defined by the conventional toilet, the post defining a channel opening at a proximal end configured to be received in the ventilated toilet seat, and at a distal end under the conventional toilet. The hose is provided for establishing fluid communication between the hinge assembly and the fin assembly.

An alternate embodiment of the present invention includes a conventional toilet seat as the primary component. The conventional toilet seat defines a toilet seat upper. A riser plate is provided and defines the concentric risers on the bottom surface thereof. The riser plate is secured to the bottom surface of the conventional toilet seat.

BRIEF DESCRIPTION OF THE DRAWINGS

The above mentioned features of the invention will become more clearly understood from the following detailed description of the invention when read together with the drawings in which.

BEST MODE FOR CARRYING OUT THE INVENTION

Figure 2A:
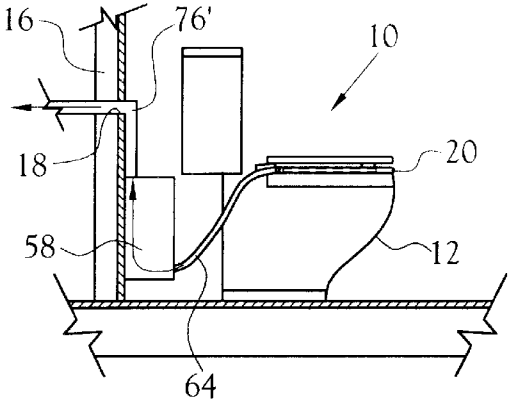
FIG. 2A is a side elevation view of the ventilated toilet seat assembly constructed in accordance with several features of the present invention showing ventilation to the exterior of the structure.

A ventilated toilet seat incorporating various features of the present invention is illustrated generally at 10 in the figures. The ventilated toilet seat assembly 10, is designed for evacuating noxious odors from within a toilet bowl 12. In the preferred embodiment the toilet seat assembly 10 is designed to be selectively operated using a remote control device 72, thereby reducing risk of electrical shock, allowing for the operation of the ventilated toilet seat assembly 10 only when necessary, and for reducing the expense of retrofitting an existing structure. Further, the toilet seat assembly 10 of the present invention is provided with a toilet seat 20 including a plurality of discrete members which, when assembled, form a conventionally shaped toilet seat having at least one internal conduit 22, thereby reducing the cost of manufacture over conventionally constructed ventilated toilet seats.

Figure 1:
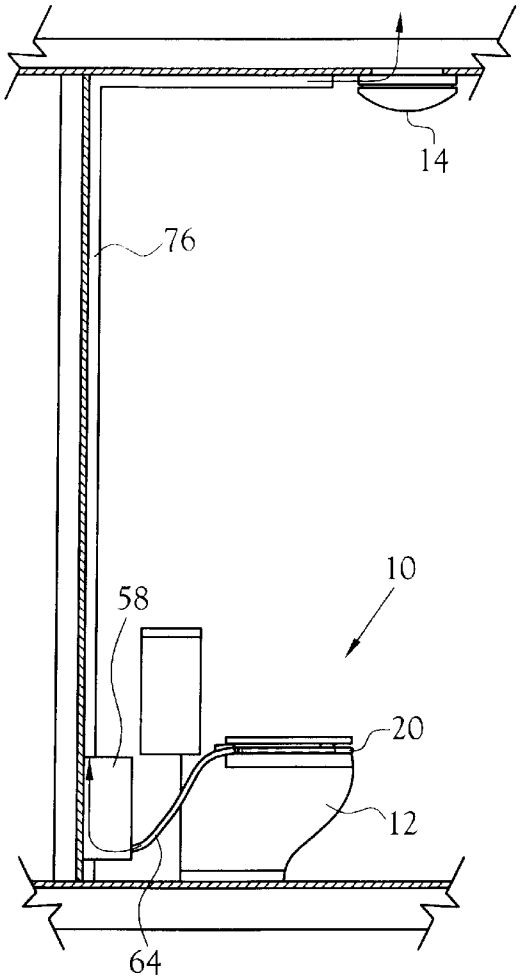
FIG. 1 is a side elevation view of the ventilated toilet seat assembly constructed in accordance with several features of the present invention showing ventilation to a ceiling mounted exhaust fan.

The ventilated toilet seat assembly 10 of the present invention is used in conjunction with a fan assembly 58 for drawing the noxious odors from within the toilet bowl 12. As illustrated in FIG. 1, the noxious odors may be evacuated from the toilet to a conventional room exhaust fan 14 mounted in the ceiling or wall. Alternatively, in those embodiments wherein the fan assembly 58 includes an air filter 62 or an air freshener of some sort, the freshened air may be returned directly to the room. To accomplish either, at least one hose 64 is connected to the outlet 26 of the ventilated toilet seat 20. A distal end 66 of each hose 64 is connected to the fan assembly 58 such that the fan assembly 58 is ultimately in fluid communication with the interior of the toilet bowl 12. Thus, as the fan 61 is operated, contaminated air within the toilet bowl 12 is drawn from within the toilet bowl 12, through the ventilated toilet seat 20, through the hoses 64, and evacuated to a selected location. In the embodiment illustrated in FIG. 1, a conduit 76 is provided for carrying the contaminated air from the fan assembly 58 to the room exhaust fan 14.

As illustrated in FIG. 2A, the contaminated air may alternatively be exhausted to the outside of the room, such as to the outside of the building or into an attic. Such configuration is especially employable in new construction, where an outlet 18 in the wall 16 of the structure is formed during construction for the specific purpose of evacuation of the contaminated air. In this embodiment, a conduit 76' is provided for fluid communication between the fan assembly 58 and the outside of the structure. To this extent, an opening 18 is defined in the wall 16 of the structure for receipt of the conduit 76'. Of course, appropriate seals (not shown) must be provided for maintaining efficiency with respect to heating and cooling systems. Because the outlet from the fan assembly 58 is to the outside of the structure, it is not necessary to provide a filter 62 within the fan assembly 58.

Figure 2B:
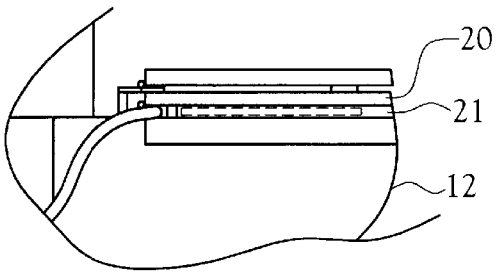
FIG. 2B is a side elevation view of the ventilated toilet seat assembly constructed in accordance with several features of the present invention showing ventilation to the exterior of the structure, and showing the incorporation of a ventilated ring.

FIG. 2B illustrates the use of a ventilated ring 21 in conjunction with a conventional toilet seat 20'. In this embodiment, the bumpers (not shown) of the conventional toilet seat 20' are removed and the ventilated ring 21 is placed between the seat 20' and the toilet 12. All other features described above are the same, and are labeled with like numerals. It will be understood that the ventilated ring 21 may be incorporated in either of the embodiments illustrated in FIGS. 1 and 2A,B in lieu of the ventilated toilet seat 20.

Figure 3:
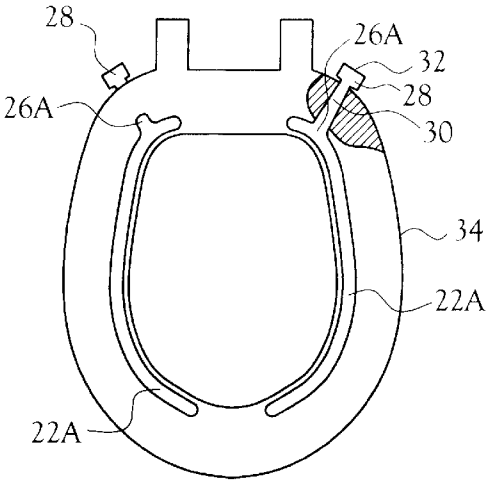
FIG. 3 is a bottom plan view of an upper member of a toilet seat constructed in accordance with several features of the present invention.

FIGS. 3–6 illustrate a ventilated toilet seat 20A, or seat 20A, constructed in accordance with the present invention. Although illustrated as defining a closed configuration, typically used in residential structures, it will be understood that any configuration of the ventilated toilet seat 20A may be used, such as the open configuration illustrated in FIGS. 7 and 8, which is more commonly used in commercial structures. Such is true for either the ventilated toilet seat 20, or the ventilated ring 21. The seat 20A illustrated in these figures is constructed primarily of a toilet seat upper 34 and a cover plate 36. As illustrated in FIG. 3, the toilet seat upper 34 is constructed in similar fashion to any conventional toilet seat. However, on the bottom surface of the toilet seat upper 34, at least one channel 22A is formed for the transport of contaminated air.

To this extent, in the method of the present invention, a conventional toilet seat is used. Channels 22A are formed in the bottom of the conventional toilet seat by removing material using a router, computerized milling machine and/or router, or other conventional tool. A through opening 26A is formed between each channel 22A and the exterior of the toilet bowl 12 to provide fluid communication from within the toilet bowl 12 to a hose 64. An adaptor 28 is provided for attaching a hose 64 to the toilet seat 20A to establish the fluid communication described. To this extent, the adaptor 28 illustrated includes a fitting 30 at one end for being closely received within the through opening 26A defined by the toilet seat upper 34, and a fitting 32 at the other end for mounting the proximal end of a hose 64 thereon. It will be understood that the adaptor 28 and the fitting 30 may be any conventional adaptor and fitting, and may be formed integrally.

Figure 4:
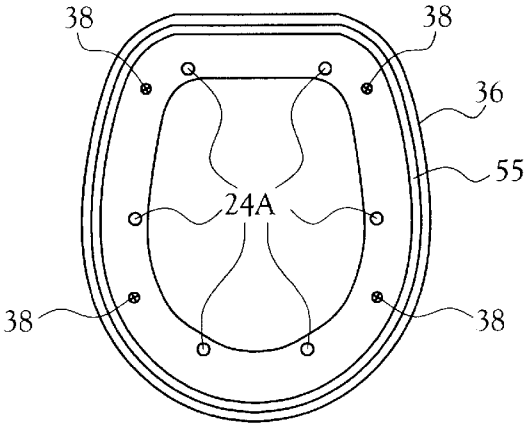
FIG. 4 is a bottom plan view of a foraminous cover for use with the upper member illustrated in FIG. 3.

FIG. 4 illustrates a cover plate 36 used in conjunction with the toilet seat upper 34 shown in FIG. 3 and described above. The general shape of the cover plate 36 is similar to that of the toilet seat upper 34 such that the outside perimeter is no larger than that of the toilet seat upper 34 and the central opening is no smaller than that of the toilet seat upper 34. As illustrated, the toilet seat upper 34 and the cover plate 36 may define substantially similar configurations. However, it is only necessary that the cover plate 36 cover at least the channels 22A defined by the toilet seat upper 34. At least one opening 24A is defined by the cover plate 36 for establishing fluid communication between the toilet bowl 12 interior and each channel 22A defined by the toilet seat upper 34. As illustrated, the preferred embodiment includes an opening 24A corresponding to each end of each channel 22A, and at least one opening 24A corresponding to a central portion of each channel 22A. This can more clearly be recognized from FIG. 5, which illustrates the cover plate 36 being secured to the toilet seat upper 34. To this extent, the cover plate 36 may be secured to the toilet seat upper 34 in any conventional fashion, such as by the illustrated screws 38, or by gluing.

Figure 5:
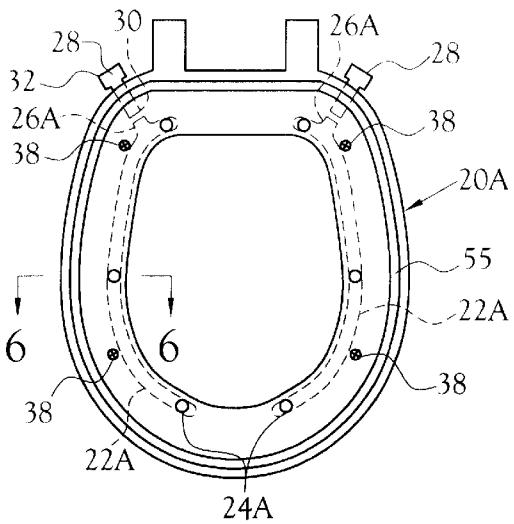
FIG. 5 is a bottom plan view of the toilet seat composed of the components illustrated in FIGS. 3 and 4.
Figure 6:
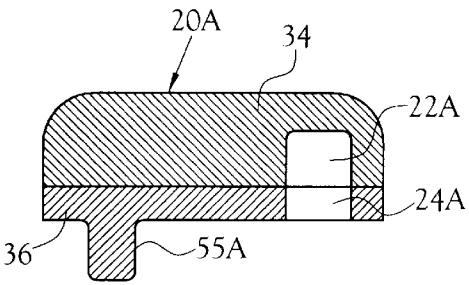
FIG. 6 is an elevation view, in section, of the toilet seat illustrated in FIG. 5, taken along section lines 6—6 thereof.

FIG. 6 illustrates a cross-section of the assembled ventilated toilet seat 20A of FIGS. 3–5. This illustration shows the relationship between the toilet seat upper 34 and the cover plate 36, with the cover plate opening 24A corresponding to the channel 22A formed in the toilet seat upper 34. FIG. 6 also more clearly illustrates a riser 55A defined by the cover plate 36. The riser 55A extends away from the toilet seat upper 34 and to engage with the top of the toilet 12 when the ventilated toilet seat 20A is lowered. The riser 55A is preferably configured to encircle the toilet bowl 12 when used in conjunction with the illustrated ventilated toilet seat 20A defining a closed configuration. The riser 55A thus serves to provide support for the ventilated toilet seat 20A and further to define a seal between the ventilated toilet seat 20A and the toilet 12. Thus, air drawn into the openings 24A must be drawn from within the toilet 12. Although the ventilated toilet seat 20A is illustrated and described as having a riser 55A, it will be understood that conventional bumpers (not illustrated) may be used to support the ventilated toilet seat 20A on the toilet 12.

Figure 7:
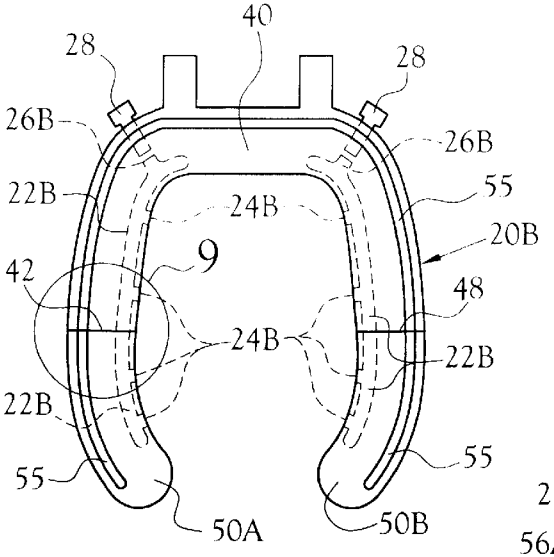
FIG. 7 is a top plan view of an alternate embodiment of a toilet seat constructed in accordance with several features of the present invention.

FIG. 7 illustrates an alternate embodiment of the ventilated toilet seat 20B wherein the ventilated toilet seat 20B is sectioned into several cooperating members. Again, it will be understood that although an open configuration is illustrated, the present invention herein described is applicable to any configuration of the ventilated toilet seat 20B, such as a closed configuration as illustrated in FIG. 6. A base member 40 is configured to be secured to the toilet bowl 12 in lieu of a conventional toilet seat. As illustrated, the base member 40 defines a substantially "C"-shaped configuration having first and second ends 42,48, and being pivotally securable to the toilet proximate the mid-section thereof The base member 40 defines at least one channel 22B terminating at one end at a through opening 26B for receiving an adaptor 28 as described above, and opening at another end at an end 42,48 of the base member 40. As illustrated, two channels 22B are preferred, with one being disposed on either side of the base member 40 and opening on each of the first and second ends 42,48. At least one through opening 26B is defined between the channel 22B and the interior portion of the base member 40 such that contaminated air may be communicated therethrough to the channel 22B for ultimate release into the atmosphere.

A pair of end members 50 are provided for securement to the first and second ends 42,48 of the base member 40. A first end member 50A is secured to the first end 42 of the base member 40 and the second end member 50B is secured to the second end 48 of the base member 40. Each of the end members 50A,B defines a portion of the channel 22B opening at the proximal end thereof corresponding to the channel 22B defined by the base member 40. The channel 22B terminates within the end member 50A,B. Each of the first and second end members 50A,B define at least one through opening 24B between the channel 22B and the interior portion of the end member 50A,B for the passage of contaminated air, in similar fashion to the through openings 24B defined by the base member 40.

Each of the base member 40 and the end members 50A,B define a portion of the riser 55B provided for support of the ventilated toilet seat 20B on the toilet 12 and for defining a seal between the ventilated toilet seat 20B and the toilet 12. Although a complete seal cannot be defined in the toilet seat configuration illustrated, extraneous air drawn into the openings 24B is limited, and a substantial portion of the air drawn into the openings 24B must come from within the toilet 12. Although the ventilated toilet seat 20B is illustrated and described as having a riser 55B, it wil be understood that conventional bumpers (not illustrated) may be used to support the ventilated toilet seat 20B on the toilet 12.

Figure 8:
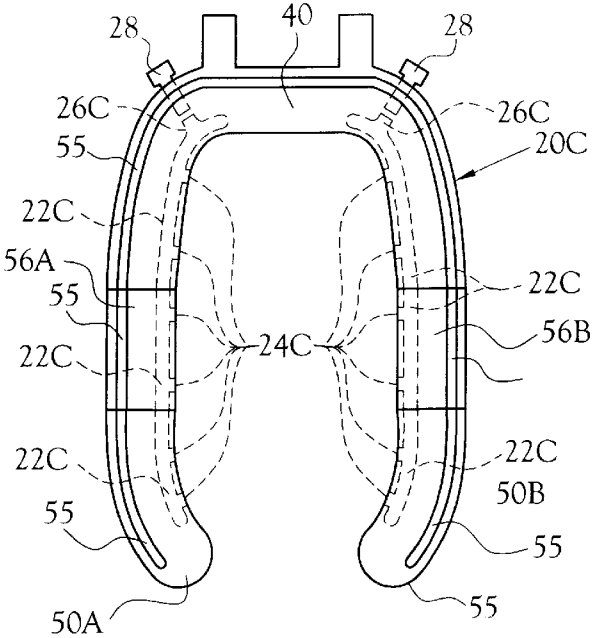
FIG. 8 is a top plan view of a further alternate embodiment of a toilet seat constructed in accordance with several features of the present invention.

As illustrated in FIG. 8, the ventilated toilet seat 20C may further be provided with at least one extension member 56 carried on either side between the base member 40 and each end member 50A,B. Each extension member 56 defines a portion of the channel 22C for the passage of contaminated air. At least one through opening 24C is defined by the extension member 56 on the interior portion thereof for the passage of contaminated air therethrough. Thus, when an extension member 56 is employed on either side of the base member 40, contaminated air passed through an end member 50A,B is then passed through the extension member 56, the base member 40, a hose 64, the fan assembly 58, and then to the atmosphere. Each of the base member 40, the end members 50A,B, and the extension members 56A,B define a portion of the riser 55C provided for support of the ventilated toilet seat 20C on the toilet 12 and for defining a seal between the ventilated toilet seat 20C and the toilet 12. Although the ventilated toilet seat 20C is illustrated and described as having a riser 55C, it will be understood that conventional bumpers (not illustrated) may be used to support the ventilated toilet seat 20C on the toilet 12.

Figure 9:
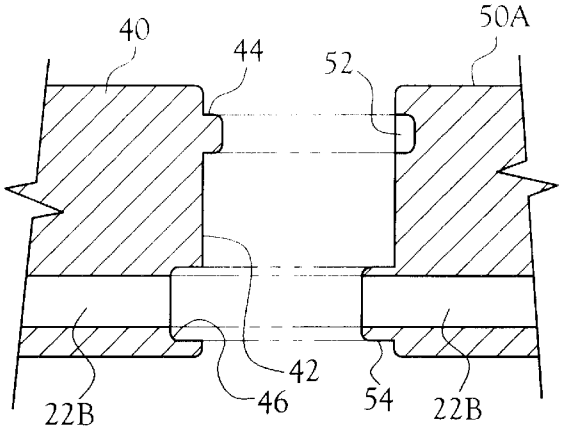
FIG. 9 is a plan view, in section, illustrating the connection of adjoining sections of the toilet seats illustrated in FIG. 7, taken at location 9 thereof.

FIG. 9 illustrates a preferred connection between either of the base member 40 and an end member 50A,B, the base member 40 and an extension member 56A,B, and an extension member 56A,B and an end member 50A,B. In the illustrated example, description is drawn to the first end 42 of the base member 40 and the proximal end of the first end member 50A. However, it will be understood that the same connection arrangement may be employed at all connections points illustrated. It will also be understood that the orientation of the connectors may be reversed will similar results. Further, it will be understood that other types of connectors may be substituted with similar results.

In the illustrated embodiment, the first end 42 of the base member 40 defines a stud 44 proximate the outside portion thereof. The base member first end 42 further defines a receptor 46 concentric with the channel 22B defined by the base member 40. The proximal end of the first end member 50A defines a female receptor 52 for closely receiving the stud 44 defined by the base member 40. The proximal end of the first end member 50A further defines an extended portion 54 concentric with the first end member channel 22B and configured to be closely received within the base portion first end receptor 46. Thus, when the base member stud 44 is received within first end member receptor 52 and the first end member extended portion 54 is received within the base member first end receptor 46, the channels 22B defined by the base member 40 and the first end member 50A are in fluid communication one with the other. Further, when the second end member 50B is also secured to the base member 40 in similar fashion, the ventilated toilet seat 20B configuration approximates that of a conventional toilet seat. Similarly, as illustrated in FIG. 8, when the extension members 56A,B are secured in similar fashion between the base member 40 and the respective end members 50A,B, the ventilated toilet seat 20C approximates a conventional toilet seat such as used in conjunction with toilets provided for the physically disabled.

It will be understood that the construction of the two embodiments described above (FIGS. 3–6 and FIGS. 7–9) may be incorporated as described, or, although not specifically illustrated, may be combined such that each of the base member 40, end members 50, and extension members 56 are constructed of an upper member and a cover plate. Such a combination provides ease of construction with adaptability for various sizes and shapes of conventional toilets 12.

Figure 11:
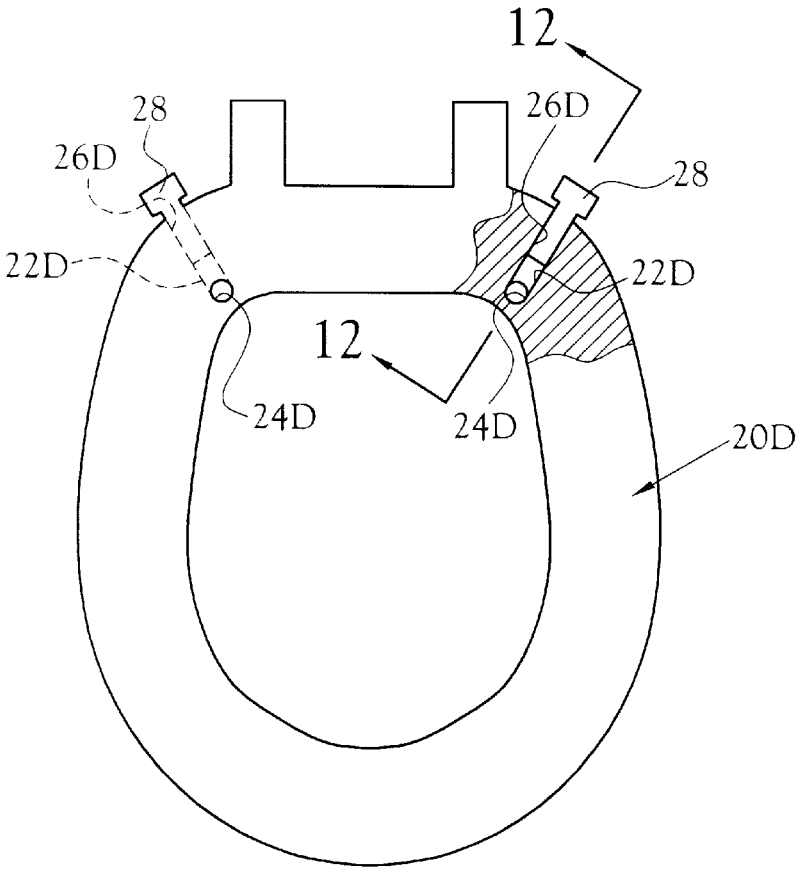
FIG. 11 is a top plan view of an alternate embodiment of a toilet seat constructed in accordance with several features of the present invention.
Figure 12:
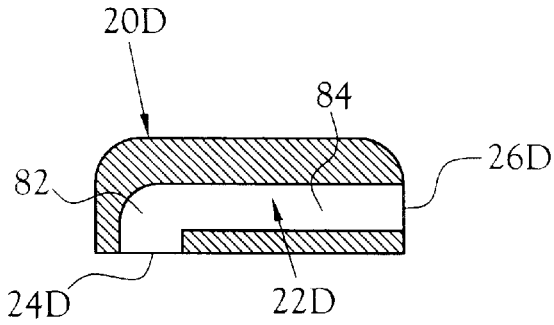
FIG. 12 is an elevation view, in section, of the toilet seat illustrated in FIG. 11, taken along line 12—12 thereof.

In a further alternate embodiment illustrated in FIG. 11 and 12, a ventilated toilet seat 20D is provided with a pair of channels 22D. Each channel 22D defines an inlet 24D on the bottom of the ventilated toilet seat 20D proximate the interior edge. Each channel 22D further defines an outlet 26D similar to that of the previous embodiments. As described above, each outlet 26D is configured to receive an adaptor 28 for fluid communication with the fin assembly 58. As illustrated most clearly in FIG. 12, each channel is defined by a vertical bore 82 opening at the inlet 24D and a horizontal bore 84 opening at the outlet 26D. The vertical bore 82 and horizontal bore 84 each terminate within the ventilated toilet seat so as to form the channel 22D. In the method of the present invention, the vertical bore 82 is formed in a conventional toilet seat, and then the horizontal bore 84 is formed. Of course, the vertical and horizontal bores 82,84 may be formed in either order. It is envisioned, further, that a single bore may be formed through the conventional toilet seat at a selected orientation to define both an inlet 24D and an outlet 26D.

Figure 13:
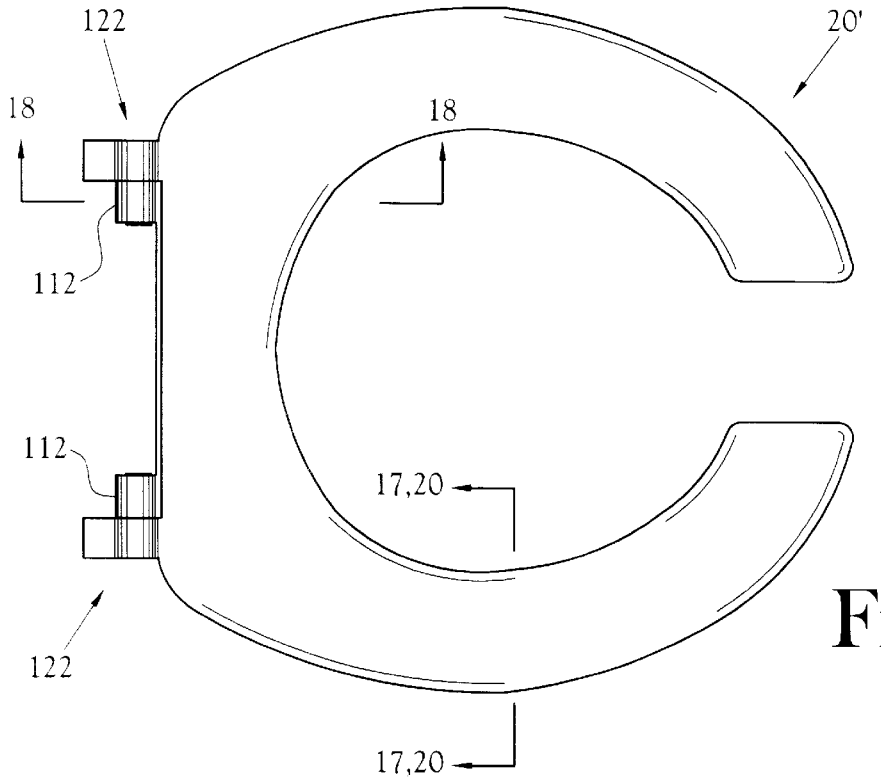
FIG. 13 is a top plan view of a preferred embodiment of a ventilated toilet seat constructed in accordance with several features of the present invention.
Figure 14:
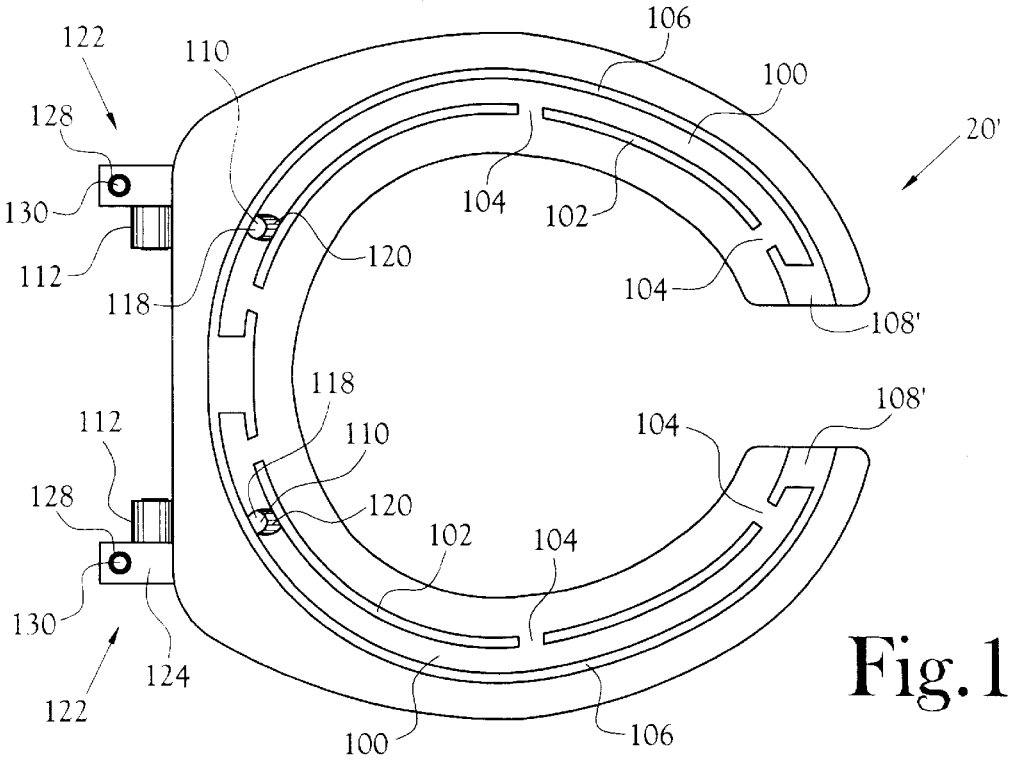
FIG. 14 is a bottom plan view of the embodiment of the ventilated toilet seat of FIG. 13.
Figure 15:
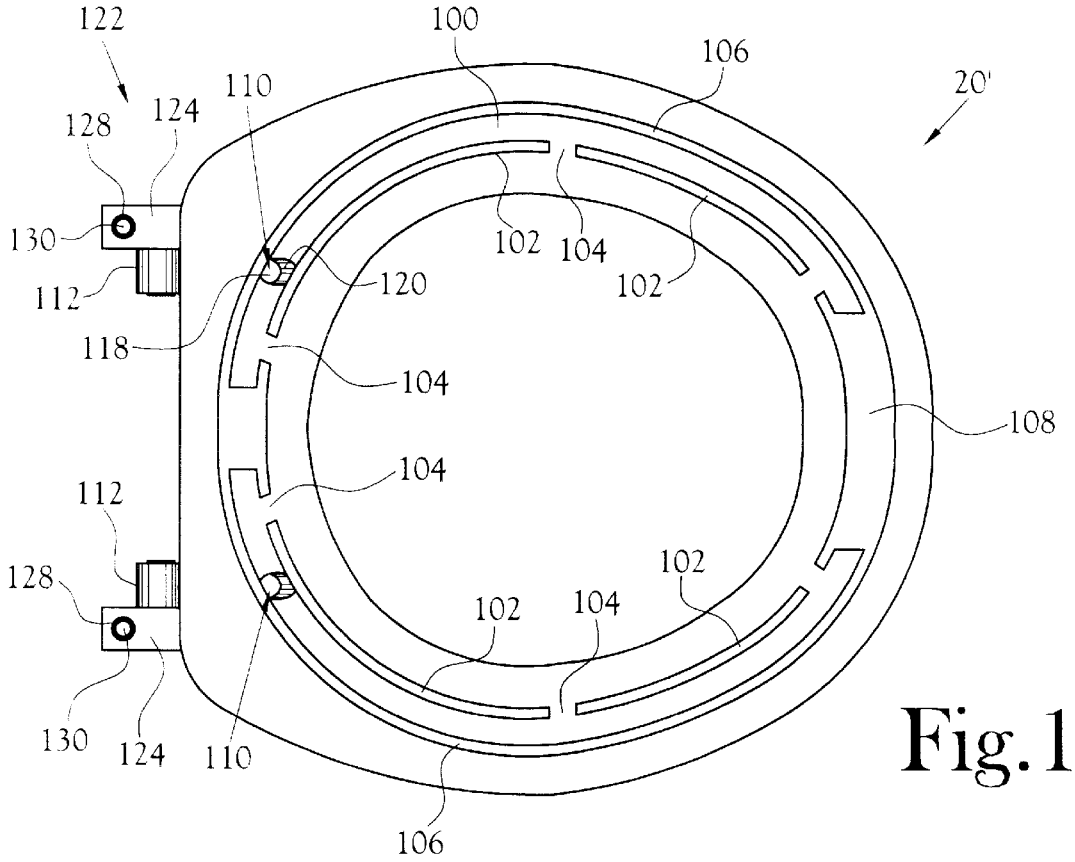
FIG. 15 is a bottom plan view of an alternate embodiment of the ventilated toilet seat.
Figure 16:
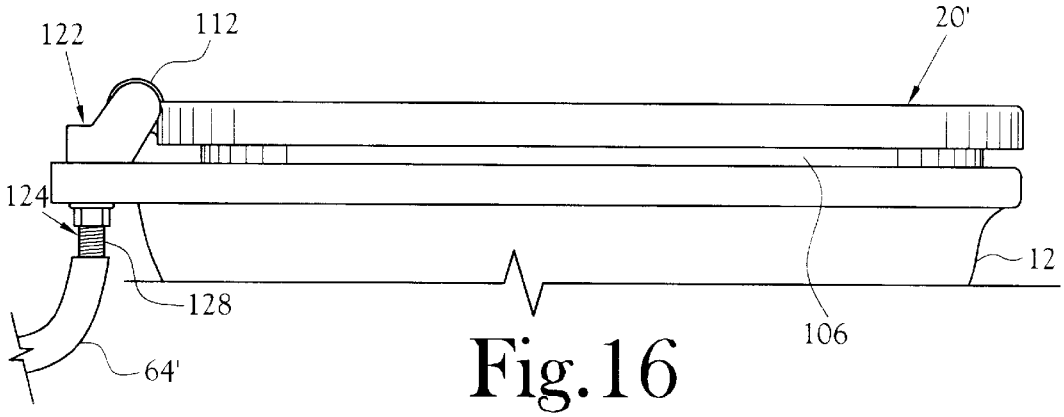
FIG. 16 is a side elevation view of the ventilated toilet seat illustrated in FIG. 13.
Figure 17:
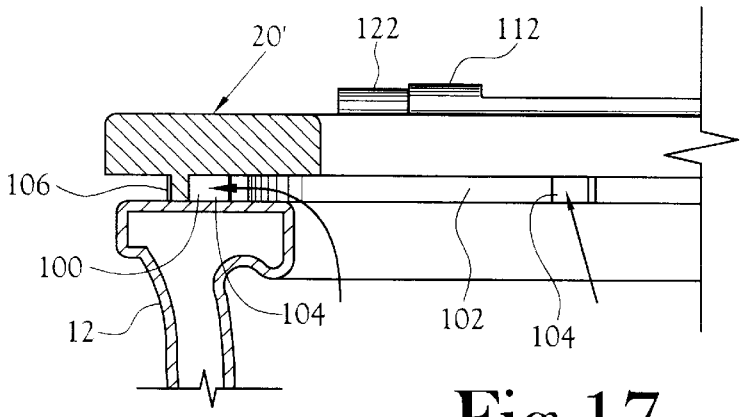
FIG. 17 is a front elevation view of the ventilated toilet seat, shown in section taken at 17—17 of FIG. 13.

Several preferred embodiments of the present invention are illustrated in FIGS. 13–20. FIG. 13 illustrates the ventilated toilet seat 20' as having a conventionally-fashioned upper surface. As most clearly illustrated in FIG. 14, the ventilated toilet seat 20' defines an external channel 100 on the lower surface thereof. Specifically, the external channel 100 is defined between a pair of concentric risers, including an innermost riser 102 and an outermost riser 106. Each of the pair of risers 102,106 is configured to form a seal along the surface of the toilet bowl 12 when the ventilated toilet seat 20' is lowered into engagement therewith, as clearly illustrated in FIG. 16. The innermost riser 102 defines a plurality of openings 104 to provide for fluid communication from within the toilet bowl 12 to the channel 100. FIG. 17 illustrates the flow of air from within the toilet bowl 12 through the openings 104 and into the external channel 100.

Figure 18:
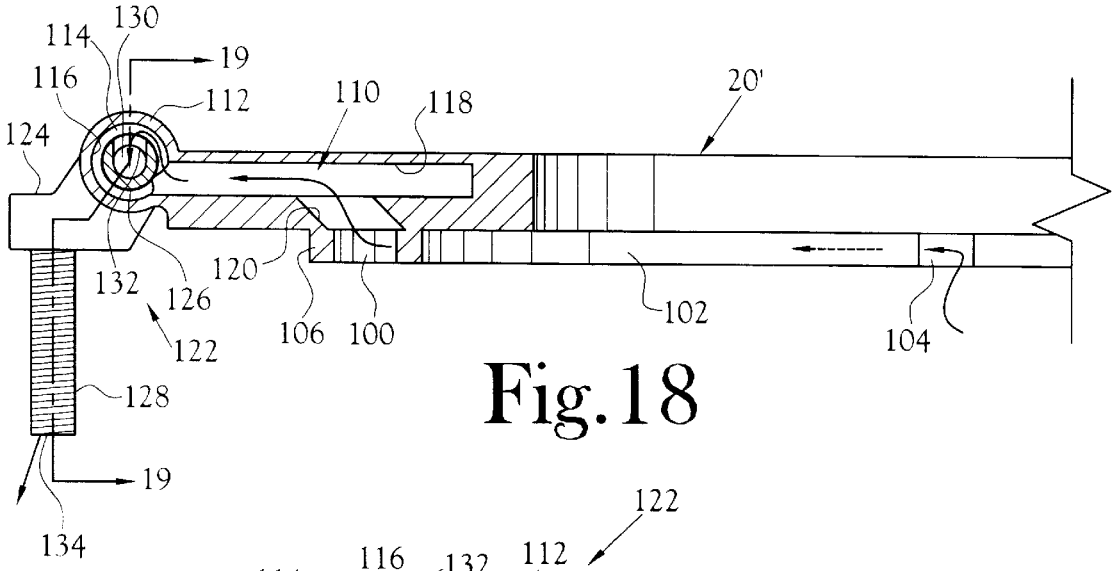
FIG. 18 is a side elevation view of the ventilated toilet seat, shown in section taken at 18—18 of FIG. 13.

FIG. 18 illustrates an outlet 110 defined between the external channel 100 and a hinge assembly 122. The ventilated toilet seat 20' defines a hinge receptor 112 extending from the back thereof. The hinge receptor 112 defines a through opening 114 for pivotally receiving the inlet portion 126 of a hinge post 124. An annular groove 116 is formed in the central portion of the through opening 114 to define a toroidal volume about the inlet portion 126 of the hinge post 124 when assembled. A first bore 118 opens at one end into the annular opening 116 and extends into the ventilated toilet seat 20' toward the external channel 100. In the preferred embodiment, the first bore 118 is disposed at a horizontal disposition A second bore 120 opens at a first end into the first bore 118 and at a second bore into the external channel 100.

Figure 19:
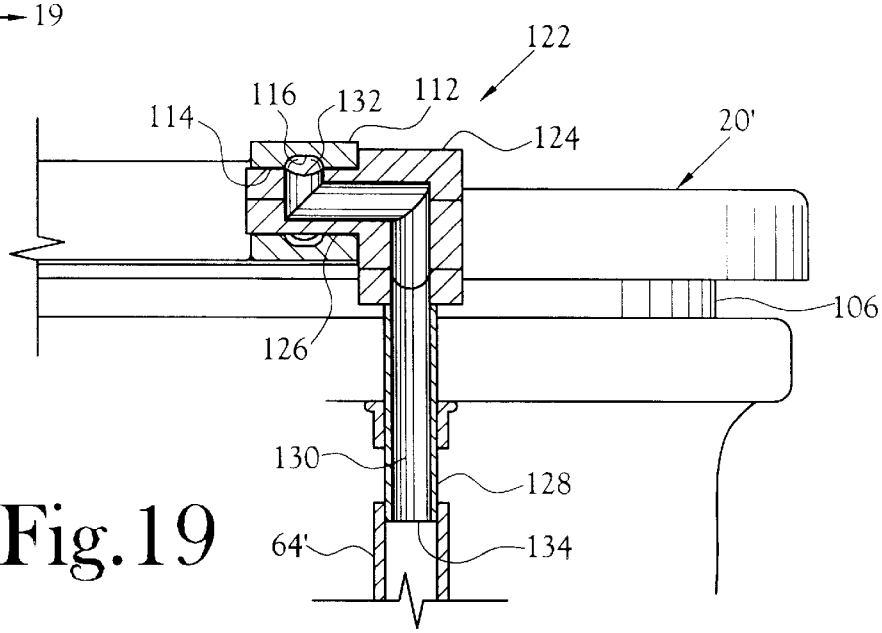
FIG. 19 is an end elevation view of the hinge assembly of the ventilated toilet seat, shown in section taken at 19—19 of FIG. 18.

The hinge post 124 is provided for mounting the ventilated toilet seat 20' to a conventional toilet 12. To this extent, the hinge post 124 defines a threaded post 128 for being received in an opening defined by the conventional toilet 12 for mounting a seat thereto. The hinge post 124 further defines an inlet portion 126 configured to be received within the ventilated toilet seat hinge receptor 112. It will be understood that the inlet portion 126 and the threaded post 128 may be individually formed and secured together in a conventional manner, or may be integrally formed as illustrated. The hinge post 124 further defines an internal conduit 130 having an inlet opening 132 on the inlet portion 126 thereof and an outlet opening 134 at the distal end of the threaded post 128. As illustrated in FIG. 19, the inlet opening 132 is disposed to establish fluid communication from the toroidal volume defined within the hinge receptor annular groove 116. Thus, air evacuated from within the toilet bowl 12 travels through the plurality of openings 104 in the innermost riser 102, through the external channel 100, through the second bore 120, then the first bore 118, through the hinge receptor annular groove 116, into the inlet portion 126 of the hinge post 124, and out of the threaded portion 128 of the hinge post 124. A hose 64' is connected to the threaded portion 128 of the hinge post 124 to deliver the air to the fan assembly 58'.

In the preferred embodiment, the above configuration is duplicated on each side of the ventilated toilet seat 20'. However it will be understood by those skilled in the art that a single such arrangement may be sufficient in some applications. In the embodiment illustrated in FIG. 15, in order to prevent cross flow between the two outlets 110, a divider 108 is provided to divide the external channel 100 into two external channels 100, terminating proximate the distal end of the ventilated toilet seat 20'. To this extent, in the embodiment illustrated in FIG. 14, wherein an open toilet seat configuration is employed, an end wall 108' is defined at the terminal end of each external channel.

Figure 20:
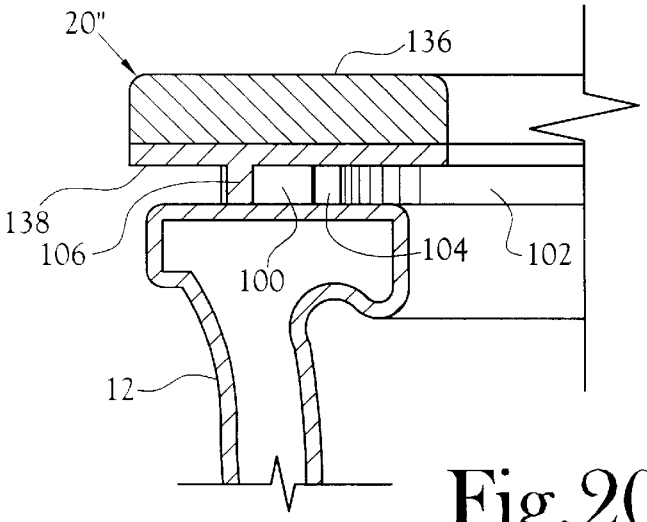
FIG. 20 is a front elevation view of a further alternate embodiment of the ventilated toilet seat, shown in section taken at 20—20 of FIG. 13.

In a further alternate embodiment illustrated in FIG. 20, the ventilated toilet seat 20' includes a toilet seat upper 136 in which is defined the first bore 118'. A riser plate 138 is provided for securement to the bottom surface of the toilet seat upper 136. The riser plate 138 defines the concentric risers 102,106 on the bottom surface thereof An opening 120' in the riser plate 138 is defined at a location proximate the first bore 118' and serves the same function as the second bore 120 in the previously described embodiment.

Figure 10:
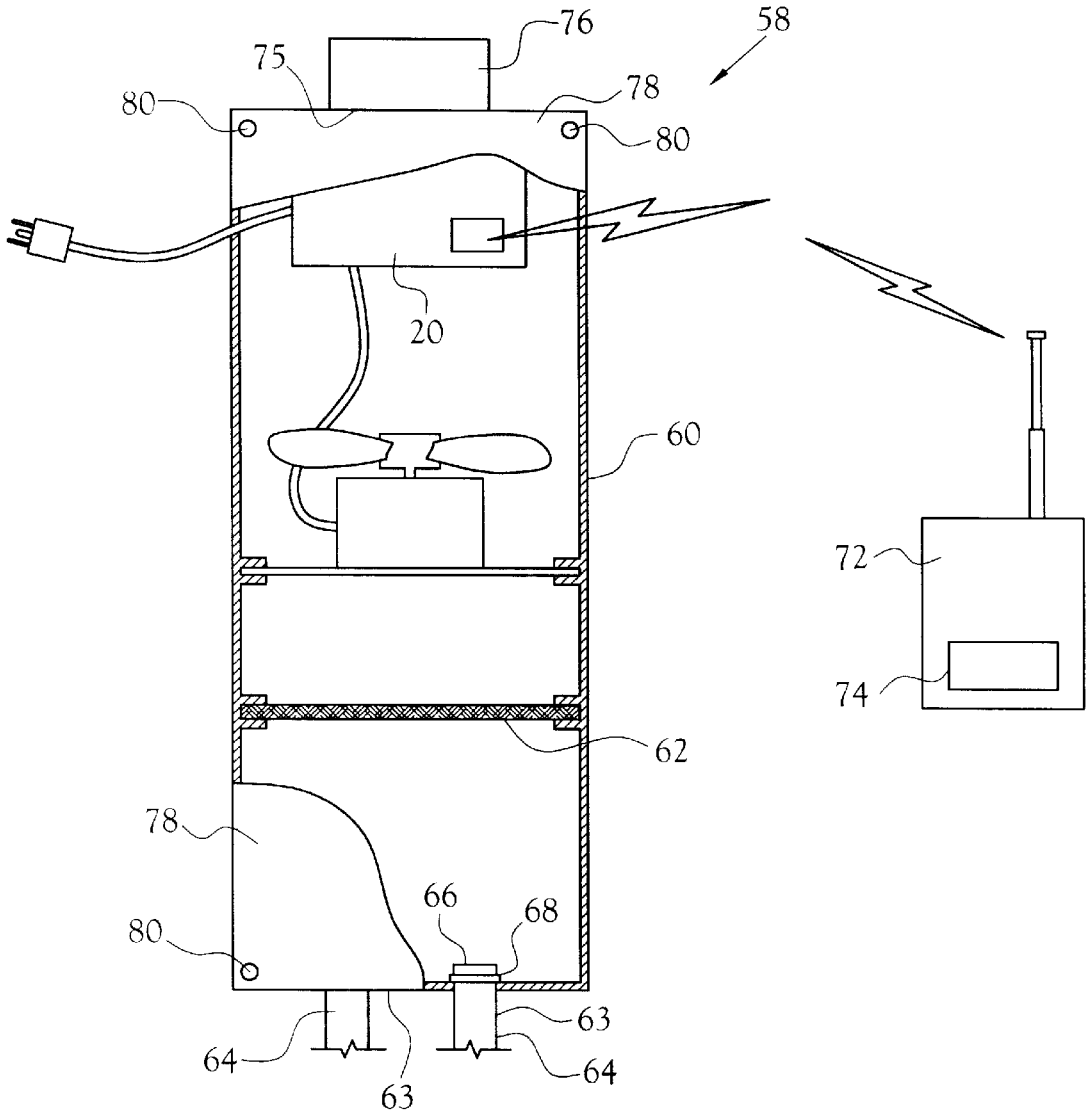
FIG. 10 is a front elevation view of the fan assembly constructed in accordance with several features of the present invention, the front cover being shown partially cut away.

The fan assembly 58 is illstrated in FIG. 10. The fan assembly 58 may be maintained at any selected location with respect to the toilet 12. To this extent, it will be understood that placement of the fan assembly 58 outside the room in which the toilet 12 is located will reduce the noise associated with the operation of the fan assembly 58.

Further, it will be understood that the fan assembly 58 is adaptable for use in association with more than one ventilated toilet seat assembly 10, such as with several toilets 12 in a residential dwelling, or with a large number of toilets 12 in a hotel, office building, restaurant, or the like. It will be understood that the fan assembly 58 as shown and described may be provided as a portion of, or in association with, a central fan unit (not shown) for additionally venting a room or other area, the central fan unit being multi-functional. Beginning with the bottom portion of the fan assembly 58, at least one inlet 63 is provided for the introduction of contaminated air. As illustrated, two such inlets 63 are provided. In the preferred embodiment, one inlet 63 is provided for each hose 64 incorporated in the present invention. However, it is anticipated that a connector or manifold (not shown) may be incorporated such that only one inlet 63, or fewer inlets 63 than hoses 64, is required. In the illustrated embodiment, each hose 64 is provided with an enlarged radius 68 at the distal end 66 thereof, and is fabricated from a flexible material such as plastic. Thus, the distal end 66 of the hose 64 may be inserted into the inlet 63 until the enlarged radius 68 is received therein. The enlarged radius 68 then serves to maintain the distal end 66 of the hose 64 within the fan assembly inlet 63. To this extent, the inlet 63 is dimensioned to be substantially equal to the diameter of hose 64.

In the illustrated embodiment wherein decontaminated air is to be reintroduced into the room at least one filter 62 is disposed above the inlet 63 in the direction of the air flow. The filter 62 may be any conventional filter. However, in the preferred embodiment, the filter 62 is activated charcoal. Contaminated air passing through the filter 62 is decontaminated and is then ready for reintroduction into the room or to any other selected location.

Above the filter 62 in the direction of the air flow is a fan 61 used for pulling air from within the toilet bowl 12. It is envisioned that the fan 61 may likewise be placed below the filter 62 in order to push air through. The electrical specifications of the fan 61 are determined primarily by the desired amount of air to be moved per unit length of time and the type and density of the filter 62. The electrical circuitry of the preferred fan 61 includes a signal receiver 70 associated with a power switch. Associated with the signal receiver 70 is a remote transmitter 72 including at least an ON/OFF switch 74 such that a user remote from the fan assembly 58 may control the operation thereof. It will be understood that, although not illustrated, any other conventional ON/OFF switch 74 may be incorporated as well, such as a wall-mounted switch, a switch mounted on the fan assembly 58, a pressure sensitive switch, a motion detector, an electric eye, or the like. An outlet 75 is provided above the fan 61 in the direction of the air flow for the evacuation of decontaminated air. As illustrated, a conduit 76 is provided for ducting the decontaminated air to the appropriate location. Referring back to FIGS. 1 and 2, the decontaminated air may be ducted to the room exhaust fin 14, or otherwise to an exterior of the room. In this embodiment, it will be understood that the use of a filter 62 is not necessary in that dissipation of any noxious fumes will be more immediate. Further, the outlet for such an embodiment may be strategically placed where noxious odors are less like to offend. In another embodiment wherein the filter 62 is incorporated, the outlet 75 may be provided with a grate (not shown) to exhaust filtered air into the room. In this embodiment, the conduit 76 is not necessary.

As illustrated, the filter 62, fan 61, and signal receiver 70 are each carried within a housing 60. A cover 78 is provided for accessing the components for servicing thereof. In the preferred embodiment, a plurality of fasteners 80 is provided for securing the cover 78 to the housing 60. Although screw-type fasteners 80 are illustrated, other conventional fasteners such as, but not limited to, hook-and-loop fasteners may be used as well. Further, although not illustrated, it will be understood that the cover 78 may be hinged to the housing 60 in a conventional manner in order to more easily access the filter 62, fan 61, and signal receiver 70. It will be understood that the housing 60 may be configured to define a one-piece construction to limit access to the components housed therein, thus eliminating the removal of the cover 78. In this embodiment, the fan assembly 58 is either disposable or repairable.

It will further be understood that air fresheners (not shown) or the like may be placed within the fan assembly 58 in the flow of air such that decontaminated air may also be entrained with a pleasing aroma.

From the foregoing description, it will be recognized by those skilled in the art that a method for forming a ventilated toilet seat assembly from a conventional toilet seat offering advantages over the prior art has been provided. Specifically, the ventilated toilet seat assembly is designed for evacuating noxious odors from within a toilet bowl. In the preferred embodiment the toilet seat assembly is designed to be selectively operated using a remote control device. Further, the toilet seat assembly is provided with a toilet seat assembly including a plural of discrete members which, when assembled, form a conventionally shaped toilet seat having at least one internal conduit, thereby reducing the cost of manufacture over conventionally constructed ventilated toilet seats.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A ventilated toilet seat comprising:

a toilet seat member defining at least one hinge receptor;

an outermost riser disposed on a lower surface of said toilet seat member, said outermost riser being configured to form a seal along a top surface of a conventional toilet bowl on which said ventilated toilet seat is mounted when said ventilated toilet seat is lowered into engagement with the toilet bowl;

an innermost riser disposed on said lower surface of said toilet seat member concentrically with said outermost riser to define an exterior channel therebetween, said innermost riser being configured to form a seal along the top surface of the conventional toilet bowl on which said ventilated toilet seat is mounted when said ventilated toilet seat is lowered into engagement with the toilet bowl, said innermost riser defining a plurality of openings to provide for fluid communication from within the toilet bowl to said exterior channel;

at least one outlet defined in said toilet seat member for establishing fluid communication between said exterior channel and said at least one hinge receptor;

a hinge assembly for mounting said toilet seat member to the conventional toilet bowl, said hinge assembly including a hinge post configured to be received in an opening defined by the conventional toilet, said hinge post defining a threaded portion for engaging a threaded nut when said hinge post is received through the opening defined by the conventional toilet seat to secure said ventilated toilet seat to the conventional toilet bowl, said hinge post defining an inlet portion configured to be received within said at least one hinge receptor, said hinge post further defining an internal conduit having an inlet opening on said inlet portion and an outlet opening at a distal end of said threaded post, said inlet opening establishing fluid communication between said internal conduit and said hinge receptor; and a hose connected in fluid communication with said internal conduit of said hinge post.

2. The ventilated toilet seat of claim 1 further defining an exterior channel end wall proximate a distal portion of said ventilated toilet seat such that a first exterior channel is defined on a first side of said ventilated toilet seat and a second exterior channel is defined on a second side of said ventilated toilet seat, and wherein one of said at least one outlet, one said hinge post, and one said hose is disposed on each of said first side and second side of said ventilated toilet seat.

3. The ventilated toilet seat of claim 1 wherein said toilet seat member includes:

a toilet seat upper defining said at least one hinge receptor, said toilet seat upper further defining a channel opening at a first end in said at least one hinge receptor; and a riser plate secured to a bottom surface of said toilet seat upper, said innermost riser and said outermost riser each being defined on a lower surface of said riser plate, said riser plate further defining a through opening between said innermost riser and said outermost riser at a proximal end of said riser plate to establish fluid communication between said exterior channel and said toilet seat upper channel, said at least one outlet being composed of said toilet seat upper channel and said riser plate through opening.

4. The ventilated toilet seat of claim 3 further defining an exterior channel end wall proximate a distal portion of said ventilated toilet seat such that a first exterior channel is defined on a first side of said ventilated toilet seat and a second exterior channel is defined on a second side of said ventilated toilet seat, and wherein one of said at least one outlet, one said hinge post, and one said hose is disposed on each of said first side and second side of said ventilated toilet seat.

5. A ventilated toilet seat comprising:

a toilet seat member defining first and second hinge receptors, each of said first and second hinge receptors defining an annular groove on an interior surface thereof;

an outermost riser disposed on a lower surface of said toilet seat member, said outermost riser being configured to form a seal along a top surface of a conventional toilet bowl on which said ventilated toilet seat is mounted when said ventilated toilet seat is lowered into engagement with the toilet bowl;

an innermost riser disposed on said lower surface of said toilet seat member concentrically with said outermost riser to define an exterior channel therebetween, said innermost riser being configured to form a seal along the top surface of the conventional toilet bowl on which said ventilated toilet seat is mounted when said ventilated toilet seat is lowered into engagement with the toilet bowl, said innermost riser defining a plurality of openings to provide for fluid communication from within the toilet bowl to said exterior channel;

an exterior channel end wall proximate a distal portion of said ventilated toilet seat such that a first exterior channel is defined on a first side of said ventilated toilet seat and a second exterior channel is defined on a second side of said ventilated toilet seat;

a first outlet defined in said first side of said toilet seat member for establishing fluid communication between said first exterior channel and said first hinge receptor annular groove;

a second outlet defined in said second side of said toilet seat member for establishing fluid communication between said second exterior channel and said second hinge receptor annular groove;

a hinge assembly for mounting said toilet seat member to the conventional toilet bowl, said hinge assembly including first and second hinge posts configured to be received in first and second openings defined by the conventional toilet, each of said first and second said hinge posts defining a threaded portion for engaging a threaded nut when said hinge post is received through the respective opening defined by the conventional toilet seat to secure said ventilated toilet seat to the conventional toilet bowl, each of said first and second hinge post defining an inlet portion configured to be received within a respective said first and second hinge receptor, each of said first and second hinge post further defining an internal conduit having an inlet opening on said inlet portion and an outlet opening at a distal end of said threaded post, said inlet opening establishing fluid communication between said internal conduit and said hinge receptor annular groove;

a first hose connected in fluid communication with said internal conduit of said first hinge post; and a second hose connected in fluid communication with said internal conduit of said second hinge post.

6. A ventilated toilet seat comprising:

a toilet seat upper defining first and second hinge receptors, each of said first and second hinge receptors defining an annular groove on an interior surface thereof said toilet seat upper further defining a first channel opening at a first end in said first hinge receptor and a second channel opening at a first end in said second hinge receptor; and a riser plate secured to a bottom surface of said toilet seat upper, said riser plate defining first and second through openings at a proximal end of said riser plate;

an outermost riser disposed on a lower surface of said riser plate, said outermost riser being configured to form a seal along a top surface of a conventional toilet bowl on which said ventilated toilet seat is mounted when said ventilated toilet seat is lowered into engagement with the toilet bowl;

an innermost riser disposed on said lower surface of said riser plate concentrically with said outermost riser to define an exterior channel therebetween, said innermost riser being configured to form a seal along the top surface of the conventional toilet bowl on which said ventilated toilet seat is mounted when said ventilated toilet seat is lowered into engagement with the toilet bowl, said innermost riser defining a plurality of openings to provide for fluid communication from within the toilet bowl to said exterior channel, said riser plate first and second through openings being disposed within said exterior channel to establish fluid communication between said exterior channel and said toilet seat upper member first and second channels;

an exterior channel end wall proximate a distal portion of said ventilated toilet seat such that a first exterior channel is defined on a first side of said ventilated toilet seat and a second exterior channel is defined on a second side of said ventilated toilet seat;

a hinge assembly for mounting said toilet seat member to the conventional toilet bowl, said hinge assembly including first and second hinge posts configured to be received in first and second openings defined by the conventional toilet, each of said first and second said hinge posts defining a threaded portion for engaging a threaded nut when said hinge post is received through the respective opening defined by the conventional toilet seat to secure said ventilated toilet seat to the conventional toilet bowl, each of said first and second hinge post defining an inlet portion configured to be received within a respective said first and second hinge receptor, each of said first and second hinge post further defining an internal conduit having an inlet opening on said inlet portion and an outlet opening at a distal end of said threaded post, said inlet opening establishing fluid communication between said internal conduit and said hinge receptor annular groove;

a first hose connected in fluid communication with said internal conduit of said first hinge post; and a second hose connected in fluid communication with said internal conduit of said second hinge post.

* * * * *